US011261819B2

(12) United States Patent
Klesse et al.

(10) Patent No.: US 11,261,819 B2
(45) Date of Patent: Mar. 1, 2022

(54) METHOD OF OPERATING A FUEL-SUPPLY SYSTEM FOR AN INTERNAL COMBUSTION ENGINE

(71) Applicant: CONTINENTAL AUTOMOTIVE GMBH, Hannover (DE)

(72) Inventors: Christoph Klesse, Woerth A.D. Donau (DE); Tobias Ritsch, Regensburg (DE)

(73) Assignee: Vitesco Technologies GmbH, Hannover (DE)

( * ) Notice: Subject to any disclaimer, the term of this patent is extended or adjusted under 35 U.S.C. 154(b) by 473 days.

(21) Appl. No.: 15/519,570

(22) PCT Filed: Oct. 13, 2015

(86) PCT No.: PCT/EP2015/073669
§ 371 (c)(1),
(2) Date: Apr. 17, 2017

(87) PCT Pub. No.: WO2016/059047
PCT Pub. Date: Apr. 21, 2016

(65) Prior Publication Data

US 2017/0241367 A1 Aug. 24, 2017

(30) Foreign Application Priority Data

Oct. 15, 2014 (DE) ..... 102014220932.3

(51) Int. Cl.
*F02D 41/38* (2006.01)

(52) U.S. Cl.
CPC .. *F02D 41/3845* (2013.01); *F02D 2200/0602* (2013.01); *F02D 2200/0606* (2013.01); *F02D 2200/0611* (2013.01); *F02D 2250/26* (2013.01)

(58) Field of Classification Search
CPC ..... F02D 41/3845; F02D 2200/0606; F02D 2250/26; F02D 2200/0602; F02D 2200/0611
See application file for complete search history.

(56) References Cited

U.S. PATENT DOCUMENTS 7,765,983 B2 8/2010 Eser et al.
8,096,284 B2 1/2012 Koidl et al.
(Continued)

FOREIGN PATENT DOCUMENTS

CN 101403358 A 4/2009
CN 101559770 A 10/2009
(Continued)

*Primary Examiner* — Jacob M Amick
*Assistant Examiner* — Charles J Brauch
(74) *Attorney, Agent, or Firm* — Laurence A. Greenberg; Werner H. Stemer; Ralph E. Locher

(57) ABSTRACT

A method operates a fuel-supply system for an internal combustion engine. The fuel-supply system contains a high-pressure fuel pump, a high-pressure fluid accumulator having a fuel-injection valve, and a high-pressure sensor. A measurement signal of the sensor is representative of a pressure within the high-pressure fluid accumulator. The high-pressure fuel pump is fluidically connected on the outlet side to the high-pressure fluid accumulator. A respective maximum injection quantity of the fuel-injection valve is determined depending on the measurement signal of the high-pressure sensor. The injection quantity is determined depending on an efficiency characteristic representing the efficiency of the high-pressure fuel pump, the efficiency characteristic depending on the measurement signal of the high-pressure sensor. The at least one fuel-injection valve is actuated in such a way that a respective injection quantity to be metered by the at least one fuel-injection valve is limited to the respective maximum injection quantity.

14 Claims, 5 Drawing Sheets

(56) References Cited

U.S. PATENT DOCUMENTS

| | | | | |
|---|---|---|---|---|
| 8,459,231 | B2 | 6/2013 | Borchsenius et al. | |
| 9,309,829 | B2 | 4/2016 | Radeczky et al. | |
| 2008/0288159 | A1* | 11/2008 | Eser | F01L 1/34 701/104 |
| 2009/0084356 | A1 | 4/2009 | Nakata et al. | |
| 2009/0090331 | A1 | 4/2009 | Pursifull | |
| 2012/0203444 | A1 | 8/2012 | Niioka | |

FOREIGN PATENT DOCUMENTS

| | | | | |
|---|---|---|---|---|
| CN | 101641510 | A | 2/2010 | |
| CN | 103765000 | A | 4/2014 | |
| DE | 10014223 | A1 | 9/2001 | |
| DE | 102011082459 | A1 | 3/2013 | |
| FR | 2833040 | A1 | 6/2003 | |
| GB | 2500206 | A | 9/2013 | |
| GB | 2500889 | A | 10/2013 | |
| JP | 2001289105 | A | 10/2001 | |
| JP | 2002106446 | A | 4/2002 | |
| JP | 2004144024 | A | 5/2004 | |
| JP | 2010024853 | A | 2/2010 | |
| JP | 2012163064 | A | 8/2012 | |
| JP | 2012233487 | A | 11/2012 | |
| JP | 2013147944 | A | 8/2013 | |
| KR | 20070107661 | A | 11/2007 | |
| WO | 2006034916 | A1 | 4/2006 | |
| WO | 2013034479 | A1 | 3/2013 | |
| WO | WO-2013034479 | A1 * | 3/2013 | F02M 65/006 |

* cited by examiner

METHOD OF OPERATING A FUEL-SUPPLY SYSTEM FOR AN INTERNAL COMBUSTION ENGINE

BACKGROUND OF THE INVENTION

Field of the Invention

The present invention relates to a method of operating a fuel-supply system for an internal combustion engine as well as a corresponding device.

Internal combustion engines are often designed to produce high torques which require large injection quantities. In contrast statutory provisions relating to the admissible emissions of harmful substances from internal combustion engines require various measures to be taken through which the emissions of harmful substances are reduced.

Document DE 100 14 223 A1 describes a device and a method for controlling an internal combustion engine. The amount of fuel to be injected is limited to a maximum value. The maximum value is at least definable dependent on a variable which characterizes the current flow rate of a fuel pump.

Document DE 10 2011 082 459 A1 describes a method of analyzing the efficiency of the high-pressure pump of a fuel-injection system in which an analysis of the efficiency of the high-pressure pump is carried out relating to individual pump strokes of the high-pressure pump, for the individual pump strokes the pressure build-up and pressure release are respectively recorded and analyzed and from the analysis of the pressure build-up or the pressure release conclusions about the condition of individual components of the high-pressure pump are drawn.

SUMMARY OF THE INVENTION

The object of the invention is to create a method, as well as a corresponding device, which contributes to making efficient operation of a fuel-supply system for an internal combustion engine as well as its cost-effective production possible.

This object is achieved through the features of the independent claim. Advantageous further developments of the invention are characterized in the sub-claims.

According to a first aspect the invention is characterized by a method of operating a fuel-supply system for an internal combustion engine. The fuel-supply system comprises a high-pressure pump, a high-pressure fluid accumulator with at least one injection valve and a high-pressure sensor, the measurement signal of which is representative of a pressure within the high-pressure fluid accumulator. On the outlet side the high-pressure pump is fluidically connected to the high-pressure fluid accumulator. Depending on the measurement signal of the high-pressure sensor a respective maximum injection quantity of the at least one injection valve is determined. Depending on the measurement signal of the high-pressure sensor an efficiency characteristic is determined. The efficiency characteristic is representative of an efficiency of the high-pressure pump. Depending on the efficiency characteristic a respective maximum injection quantity of the at least one injection valve is determined.

The at least one injection valve is controlled in such a way that the respective injection quantity to be metered is limited to the respective maximum injection quantity.

Limiting the respective injection quantity to be metered of the at least one injection valve contributes to the fact that a stroke volume of the high-pressure pump can be particularly small. This can be attributed to the fact that through limiting the respective injection quantity to be metered this contributes to countering a fall in pressure in the high-pressure fluid accumulator, more particularly to preventing it. The fall in pressure can occur in particular if a maximum flow rate of the high-pressure pump within an operating cycle of the internal combustion engine is less than a total injection quantity of all injection valves. In particular an increased emission of harmful substances is avoided and a contribution is made to efficient operation of the internal combustion engine.

The maximum flow rate of the high-pressure pump is for example dependent on the stroke volume of the high-pressure pump. The maximum flow rate of the high-pressure pump is for example also dependent on an efficiency of the high-pressure pump. In particular, limiting the respective injection quantity to be metered contributes to preventing a fall in pressure in the high-pressure fluid accumulator, due to a for example wear-related reduction in the efficiency of the high-pressure pump over the lifetime of the high-pressure pump. Additionally, limiting the respective injection quantity to be metered contributes, for example, to the prevention of a fall in pressure in the high-pressure fluid accumulator due to an extreme output being required of the internal combustion engine.

Advantageously a dimension of the high-pressure pump can be designed to be particularly small. In addition, through a thereby reduced space required by the high-pressure pump an incorporation position of the high-pressure pump becomes flexible. In connection with this there is also a reduction in a weight of the high-pressure pump as well as a reduction in a torque required for operating the high-pressure pump so that a contribution is made to efficient operation of the fuel-supply system and its cost-effective production.

The respective maximum injection quantity is in particular specified in such a way that the pressure in the high-pressure fluid accumulator can be kept at a respective predetermined pressure level. In particular a respective limit injection quantity that can be metered during the working cycle of the internal combustion engine at a maximum possible opening duration of the at least one injection valve is greater than the respective maximum injection quantity.

A fluidic connection of the high-pressure pump to the pressure limiting valve and the high-pressure fluid accumulator is in particular a hydraulic connection. An area on the outlet side of the high-pressure pump can also be designated as a high-pressure area.

In an advantageous embodiment according to the first aspect depending on the measurement signal of the high-pressure sensor a flow rate characteristic is determined. The flow rate characteristic is representative of a flow rate of the high-pressure pump. Depending on the flow rate characteristic the respective maximum injection quantity is determined.

By determining the flow rate characteristic a conclusion about the maximum flow rate of the high-pressure pump can be drawn, for example. In addition, the respective maximum injection quantity can be reliably determined, for example, so that a contribution to the efficient operation of the fuel-supply system and its cost-effective production is particularly advantageously made. In this respect the flow rate characteristic is particularly representative of a quantity of fluid flowing to the high-pressure area of the fuel-supply system.

Advantageously, through determining the efficiency characteristic a precise conclusion can be drawn with regard to the maximum flow rate of the high-pressure pump. For example, the efficiency characteristic is only determined at the time of an initial start-up of the fuel-supply system. Alternatively the efficiency characteristic is determined for example at the time of every start-up of the fuel-supply system.

In particular the efficiency characteristic is representative of a comparison of the determined maximum flow rate with a theoretical maximum flow rate of the high-pressure pump. The efficiency characteristic can also be designated as the volumetric efficiency of the high-pressure pump.

For example, the flow rate characteristic is determined depending on the efficiency characteristic. Alternatively, for example, the efficiency characteristic is determined depending on the flow rate characteristic.

In a further advantageous embodiment according to the first aspect at least one fuel characteristic is provided. The fuel characteristic is in each case representative of an elasticity modulus of a respective fuel type. The respective maximum injection quantity is determined depending on the at least one fuel characteristic.

The respective maximum injection quantity can thus be precisely determined. In the event that the fuel-supply system does not have a fuel sensor for determining the respective fuel type, the respective maximum injection quantity is determined for example depending on the fuel characteristic, corresponding to a respective fuel type, at which the respective injection quantity of the respective fuel to be metered is at a maximum.

The respective fuel characteristic is, for example, dependent on the pressure within the high-pressure fluid accumulator. The respective fuel characteristic is, for example, alternatively or additionally dependent on a temperature within the high-pressure fluid accumulator.

As part of the determination of the respective maximum injection quantity the respective fuel characteristic is provided, for example, as a fuel characteristic map.

In a further advantageous embodiment according to the first aspect the fuel-supply system comprises a fuel sensor. Depending on a measurement signal of the fuel-supply system the fuel type of a fuel present in the fuel-supply system is determined.

In this way the respective maximum injection quantity can be particularly precisely determined.

In a further advantageous embodiment according to the first aspect at least one pressure characteristic is provided. The at least one pressure characteristic is in each case representative of a time course of the pressure within the high-pressure fluid accumulator. The respective maximum injection quantity is determined depending on the at least one pressure characteristic.

The respective maximum injection quantity can thus be determined merely through comparing the measurement signal of the pressure sensor with the at least one pressure characteristic so that on the basis of a low performance requirement of data processing associated therewith a contribution to cost-effective production of the fuel-supply system is made.

For example, the respective pressure characteristic is dependent on the efficiency of the high-pressure pump. Alternatively or additionally the respective pressure characteristic is, for example, dependent on the flow rate of the high-pressure pump. The respective pressure characteristic is, for example, also dependent on the temperature within the high-pressure fluid accumulator.

As part of the determination of the respective maximum injection quantity the pressure characteristic is provided, for example, as a pressure characteristic map.

In a further advantageous embodiment according to the first aspect a temperature characteristic is provided. The temperature characteristic is representative of a temperature within the high-pressure fluid accumulator. The respective maximum injection quantity is determined depending on the temperature characteristic.

This permits precise determination of the respective maximum injection quantity. The temperature characteristic can, for example, be determined depending on an emitted output of the internal combustion engine so that an additional temperature sensor is not required.

In a further advantageous embodiment according to the first aspect the fuel-supply system comprises a temperature sensor. The temperature characteristic is determined depending on a measurement signal of the temperature sensor.

In this way the temperature characteristic can be particularly precisely determined.

In a further advantageous embodiment according to the first aspect the respective maximum injection quantity is determined depending on a build-up of pressure within the high-pressure fluid accumulator in a predetermined time interval after switching the internal combustion engine to a switched on operating mode.

This permits particularly reliable determination of the respective maximum injection quantity.

According to a second aspect the invention is characterized by a device for operating a fuel-supply system which is designed to implement a method according to the first aspect.

Examples of embodiment of the invention are explained below by way of the schematic drawings.

DESCRIPTION OF THE INVENTION

Elements of the same design or function are provided with the same reference numbers throughout the figures.

Figure 1:
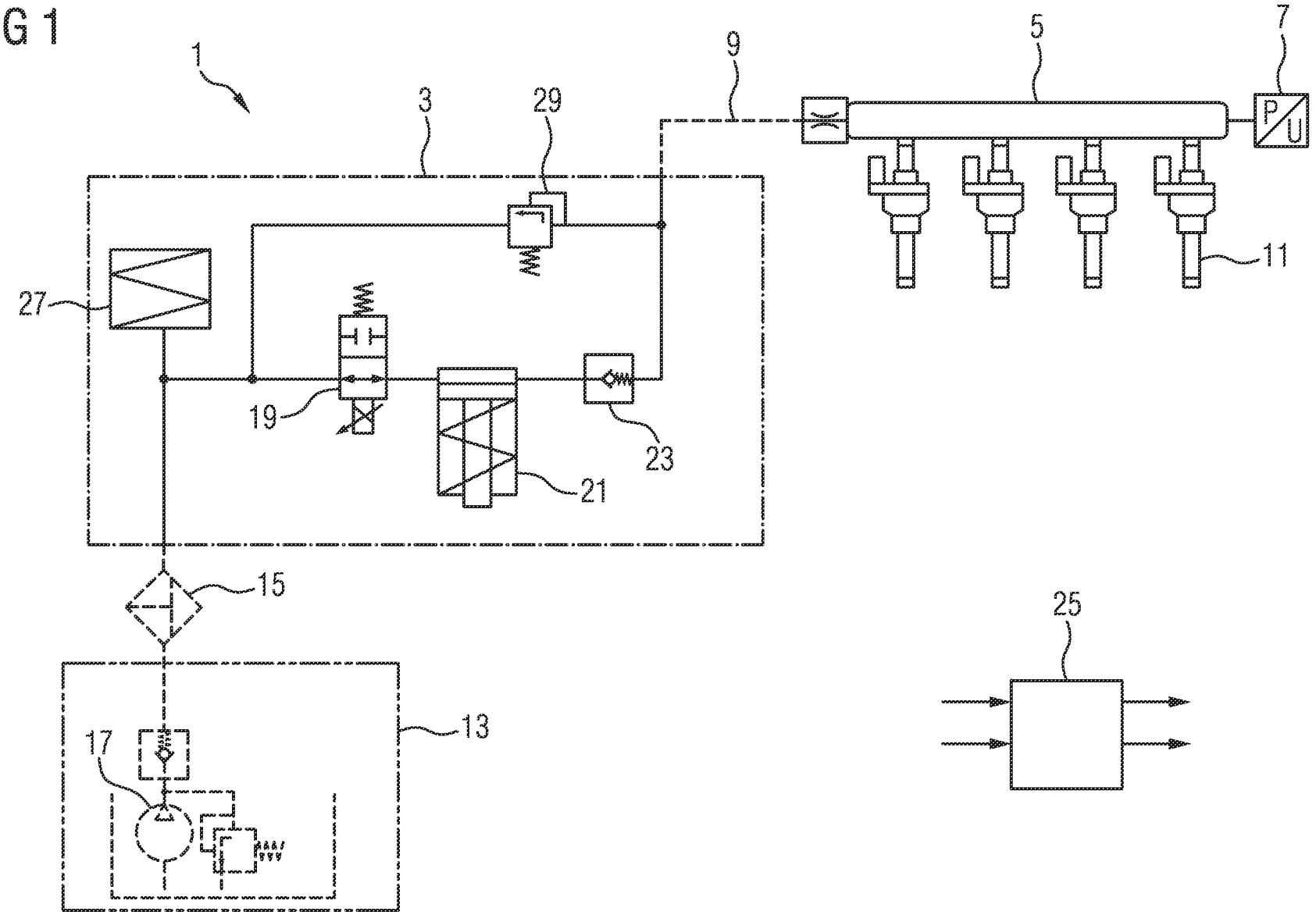
FIG. 1 shows a first example of embodiment of a fuel-supply system for an internal combustion engine.

A fuel-supply system 1 (FIG. 1) for an internal combustion engine comprises a high-pressure pump 3 as well as a high-pressure fluid accumulator 5 and a high-pressure sensor 7. On the outlet side the high-pressure pump 3 is fluidically connected to the high-pressure fluid accumulator 5. For this purpose the fuel-supply system 1 has a supply line 9 for example.

The high-pressure fluid accumulator 5 comprises several injection valves 11 for dispensing fluid, in particular fuel, into a combustion chamber of the internal combustion engine.

The supply line 9, as well as the high-pressure fluid accumulator 5 with the injection valves 11 and the high-pressure sensor 7 are, in particular, arranged in a high-pressure area of the fuel-supply system 1. A measurement signal of the high-pressure sensor 7 is, in particular, representative of a pressure P within the high-pressure area.

The fuel-supply system 1 comprises, for example, a fluid reservoir 13, which provides fluid, in particular fuel, for a combustion process of the internal combustion engine. On the inlet side the fluid reservoir 13 is fluidically connected to the high-pressure pump 3. Arranged between the fluid reservoir 13 and the high-pressure pump 3 is, for example, a fluid filter 15. A feed pump 17, for example, is also assigned to the fluid reservoir 13. The feed pump 17 is designed as an electric pre-feed pump for example. The fuel-supply system 1 is arranged in a motor vehicle for example.

The fluid reservoir 13 with the feed pump 17 and the fluid filter 15 are in particular arranged in a low-pressure area of the fuel-supply system 1.

The high-pressure pump 3 is in particular controllable for increasing the pressure P of the fluid on the outlet side of the high-pressure pump 3, in particular in the high-pressure area. More particularly, on the outlet side of the high-pressure pump 3 the pressure P is increased to a respective predetermined pressure level with which an injection takes place for example.

The high-pressure pump 3 comprises an inlet valve 19 for example. The inlet valve 19 is for example designed as a digital inlet valve. The high-pressure pump 3 also comprises a piston pump 21 and an outlet valve 23 for example. In other examples of embodiment the high-pressure pump 3 is designed as a pendulum slide machine for example.

Also assigned to the fuel-supply system 1 is, for example, a control device 25 for operating the fuel-supply system 1 which in particular comprises a data and program memory. The control device 25 can also be designated as a device for operating the fuel-supply system 1.

The fluid used in the fuel-supply system 1 of the first example of embodiment is preferably gasoline.

In the first example of embodiment the high-pressure pump 3 comprises a damper 27 for example. In particular this is a low-pressure damper. The damper 27 is designed to provide a volume in the low-pressure area for equalizing pressure fluctuations.

In the first example of embodiment the high-pressure pump 3 also comprises a pressure limiting valve 29 for example. In particular the pressure limiting valve 29 contributes to a maximum pressure within the high-pressure area being limited so that a requirement relating to a pressure resistance of one or more components in the high-pressure area can be kept low.

A cycle of the high-pressure pump 3 comprises, for example, a suction phase and a delivery phase. The high-pressure pump 3 is controllable, in particular during the suction phase of the high-pressure pump 3 to draw in fluid from the fluid reservoir 13 into a displacement volume of the high-pressure pump 3 in order to make it available for the delivery phase. Through the interaction of the piston pump 21 with the inlet valve 19 the drawn-in fluid is conveyed onwards for example. In the delivery phase of the high-pressure pump 3, fluid is provided at the outlet side of the high-pressure pump 3. A flow rate $V_i$ denotes here the quantity of fluid provided at the outlet side of the high-pressure pump 3 during a working cycle of the internal combustion engine.

A total quantity of the fluid that is discharged through the injection valves 11 during the injection, in particular during the working cycle of the internal combustion engine, can also be designated as the total injection quantity Vo. Herein, each of the injection valves 11 discharges a respective injection quantity to be metered.

Figure 2:
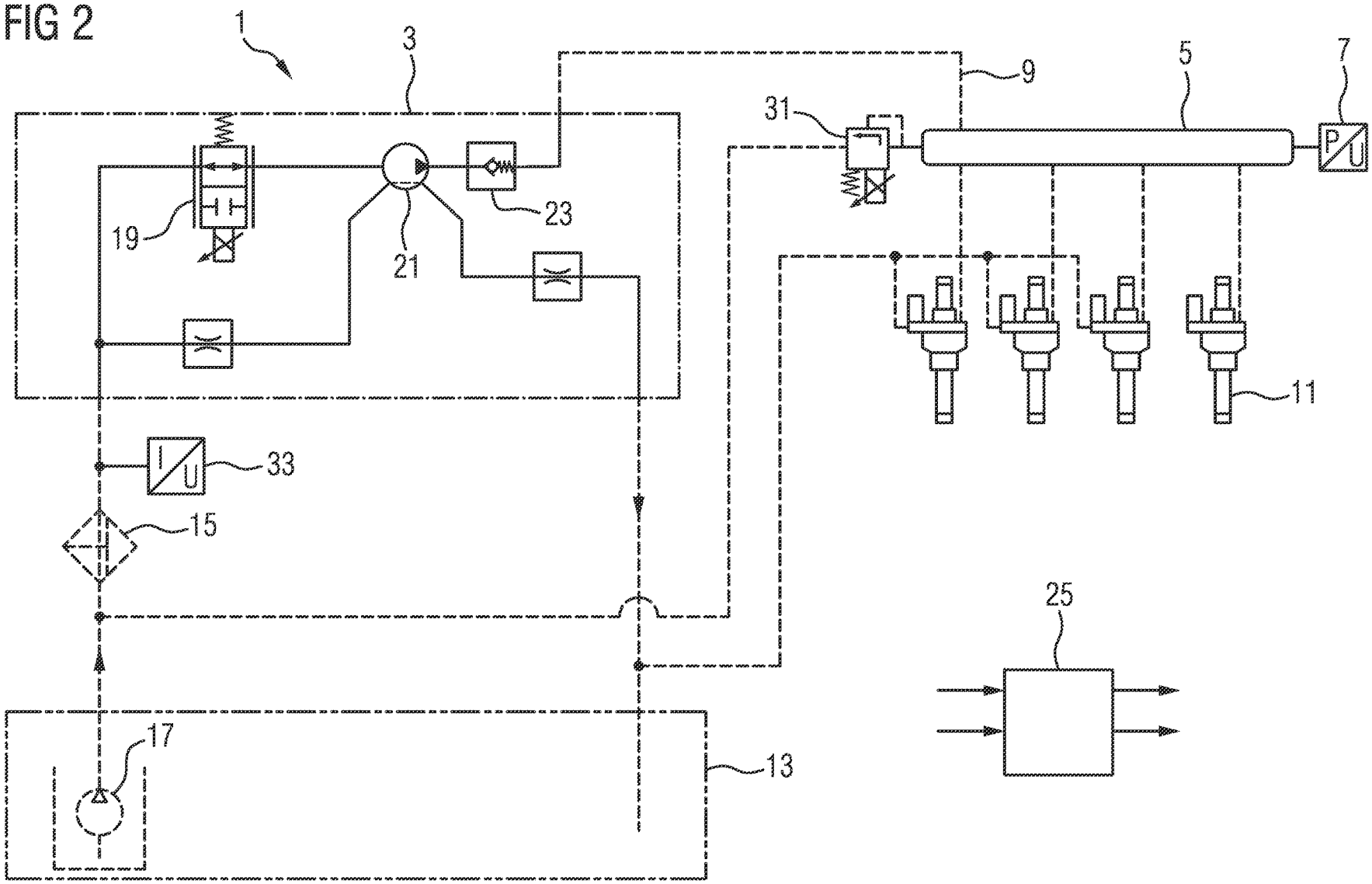
FIG. 2 shows a second example of embodiment of a fuel-supply system for the internal combustion engine.

The fluid used in the fuel-supply system 1 of the second example of embodiment (FIG. 2) is preferably diesel.

The fuel-supply system 1 in the second example of embodiment differs from the first example of embodiment at least in that instead of the pressure limiting valve 29 a pressure regulating valve 31 is fluidically connected to the high-pressure fluid accumulator 5.

Additionally the fuel-supply system 1 comprises, for example, a temperature sensor 33 the measurement signal of which is representative of a temperature T1, T2, T3 within the high-pressure fluid accumulator.

Figure 3A:
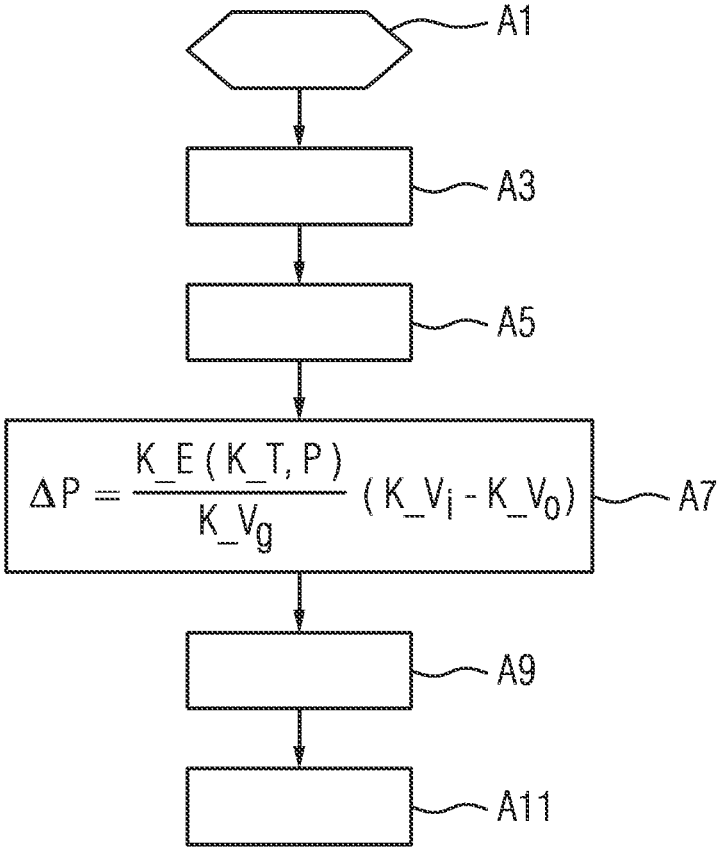
FIG. 3*a* shows a first flow diagram for operating a fuel-supply system according to FIG. 1 and FIG. 2.

Stored in particular in the data and program memory of the control device 25 is a first program which will be explained in more detail below by way of the first flow diagram of FIG. 3*a*.

The first program is started in a step A1, for example when the internal combustion engine is switched on. During this the high-pressure pump 3 is in particular controlled to increase the pressure P within the high-pressure area.

At a point in time at which the internal combustion engine is switched on, the pressure P in the high-pressure area is typically lower than the respective predetermined pressure level of the fuel-supply system 1. The first program is continued in a step A3.

In step A3 in a predetermined time interval, depending on the measurement signal of the high-pressure sensor 5 a gradient of the pressure P, in particular a pressure build-up ΔP within a hydraulic volume of the fuel-supply system 1 is determined. The hydraulic volume comprises, for example, the displacement volume of the high-pressure pump 3, the high-pressure fluid accumulator 5, the supply line 9 as well as the injection valves 11. The first program is continued in a step A5.

In step A5 at least one fuel characteristic K_E is provided which is representative of an elasticity modulus of a respective fuel type.

For example in connection with this a fuel sensor is assigned to the fuel-supply system 1, the measurement signal of which is representative of the fuel type of a fuel present in the fuel-supply system 1. For example, depending on the measurement signal of the fuel sensor the respective fuel characteristic K_E is determined which corresponds to the fuel type of the fuel present in the fuel-supply system 1.

Alternatively, for example, the respective fuel characteristic K_E is determined which corresponds to a fuel type which minimizes an emitted output of the internal combustion engine.

In addition, for example, a temperature characteristic K_T is provided which is representative of the temperature T1, T2, T3 within the high-pressure fluid accumulator 5. The temperature characteristic K_T can, for example, be determined depending on the emitted output of the internal combustion engine. As an alternative the temperature characteristic K_T is determined depending on the measurement signal of the temperature sensor 33.

For example, the at least one fuel characteristic K_E is determined depending on the temperature characteristic K_T. Additionally or alternatively the at least one fuel characteristic K_E is determined depending on the pressure P within the high-pressure fluid accumulator 5. In particular, in this context the at least one fuel characteristic K_E is provided as a respective fuel characteristic map. The respective fuel type can, for example, be one of EN228, E20, E85, E100 or a diesel fuel.

Additionally a total volume characteristic K_Vg is provided which is representative of the hydraulic volume. Additionally an injection quantity characteristic K_Vo is provided which is representative of the total injection quantity Vo. The first program is continued in a step A7.

In step A7 a flow rate characteristic K_Vi is determined depending on the pressure build-up ΔP, the total volume characteristic K_Vg, the injection quantity characteristic K_Vo and the fuel characteristic K_E which is representative of the flow rate Vi of the high-pressure pump 3. The flow rate Vi of the high-pressure pump 3 is particularly dependent on the displacement volume of the high-pressure pump 3 as well as an efficiency η of the high-pressure pump 3.

In addition an efficiency characteristic is determined which is representative of the efficiency η of the high-pressure pump 3. More particularly the efficiency characteristic is representative of a volumetric efficiency of the high-pressure pump 3. For example, in this context a displacement volume characteristic which is representative of the displacement volume of the high-pressure pump 3 is provided. The efficiency characteristic is determined in particular depending on the displacement volume characteristic and the flow rate characteristic K_Vo.

The efficiency characteristic is also determined depending on the pressure P (see FIG. 4), for example. The efficiency characteristic is also determined depending on a pump speed v for example. The first program is then continued in a step A9.

In step A9 the respective maximum injection quantity of the injection valves 11 is determined depending on the efficiency characteristic. For example, for this a maximum flow rate Vimax of the high-pressure pump 3 in the working cycle of the internal combustion engine is initially determined, depending on which the respective maximum injection quantity is determined.

For example the respective maximum injection quantity is determined depending on a number of injection valves 11. For example the respective maximum injection quantity is determined depending on a transmission ratio of the pump speed to a speed of the internal combustion engine. The first program is then continued in a step A11.

In step A11 the injection valves 11 are controlled to limit the respective injection quantity to be metered to the respective maximum injection quantity. In particular the respective injection quantity to be metered is only limited if the maximum flow rate Vimax of the high-pressure pump 3 is less than the total injection quantity Vo (see FIG. 5). The program is then ended.

Figure 3B:
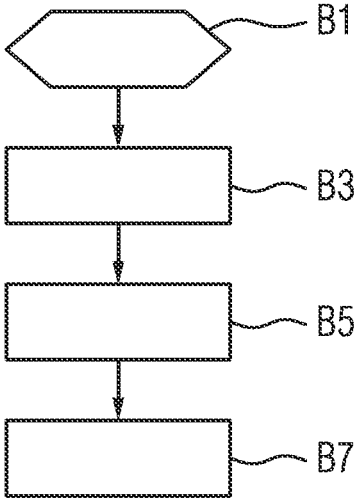
FIG. 3*b* shows a second flow diagram for operating a fuel-supply system according to FIG. 1 and FIG. 2.

More particularly, alternatively and/or in addition to the first program, in the data and program memory of the control device 25 a second program is stored which will be explained in more detail below by means of the second flow diagram of FIG. 3*b*.

In a step B1 the second program is started in an analogous manner to A1 and continued in a step B3.

Figure 6:
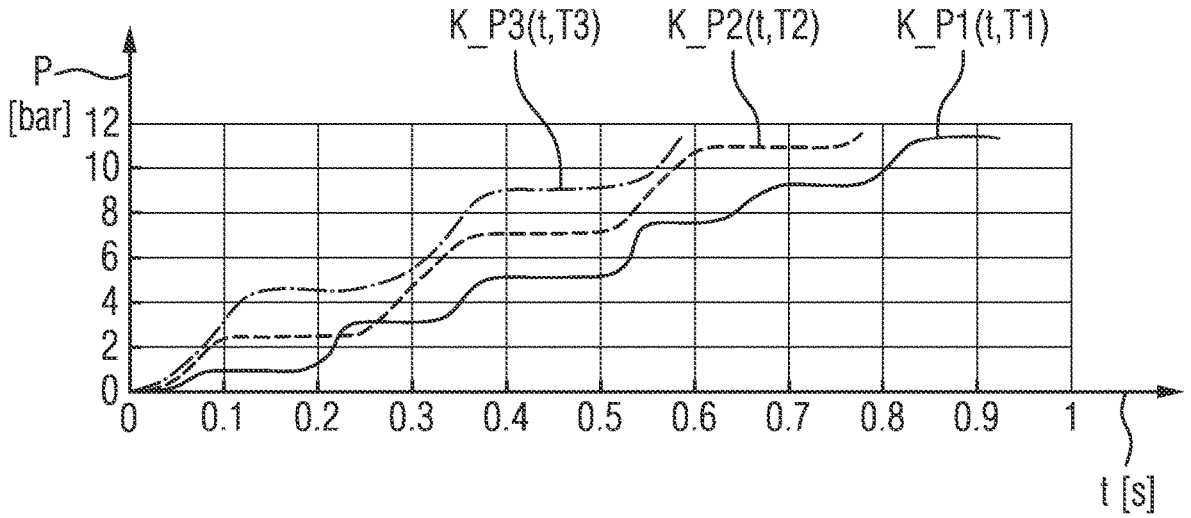

In step B3 at least one pressure characteristic K_P1, K_P2, K_P3 is provided which in each case is representative of a time course of the pressure P within the high-pressure fluid accumulator 5 (see FIG. 6). In particular the at least one pressure characteristic K_P1, K_P2, K_P3 is representative of a time course of the pressure P as a function of the efficiency η of the high-pressure pump 3. Alternatively the at least one pressure characteristic K_P1, K_P2, K_P3 is for example representative of a time course of the pressure P as a function of the flow rate Vi of the high-pressure pump 3.

Depending on a comparison of the at least one pressure characteristic K_P1, K_P2, K_P3 with the measurement signal of the high-pressure sensor 7 the efficiency characteristic is determined. For example the comparison is carried out after the predetermined time interval. Alternatively and/or additionally the comparison is carried out after a predetermined number of cycles of the high-pressure pump 3 for example.

For example, in this context the temperature characteristic K_T is also provided, depending on which the efficiency characteristic is determined. For example the efficiency characteristic is also determined depending on the pressure P (see FIG. 4). For example the efficiency characteristic is also determined depending on a pump speed v. The second program is continued in a step B5.

In step B5 the respective maximum injection quantity is determined depending on the efficiency characteristic in a manner analogous to step A9. The second program is also continued in a step B7 analogously to A11 and then ended.

The first and the second program can in particular be executed separately or combined into a single program. Advantageously through this a fall in pressure during the injection even in the case of a small displacement volume of the high-pressure pump 3 is prevented.

Figure 4:
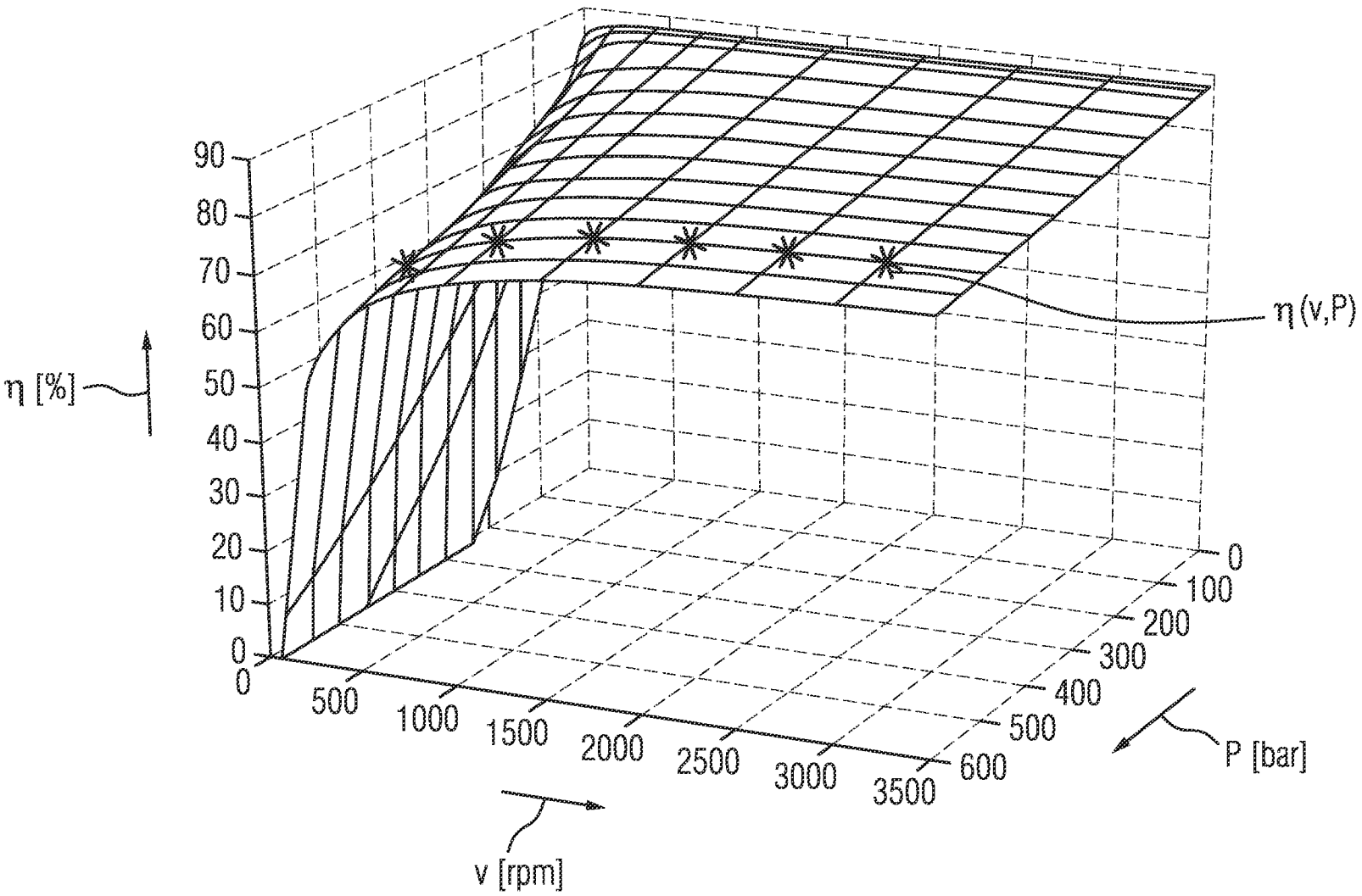
FIG. 4 shows an efficiency of a high-pressure pump of a fuel-supply system according to FIG. 1 and FIG. 2.

FIG. 4 shows the efficiency η dependent on the pump speed v and the pressure P at a predetermined temperature T1, T2, T3 at a start of the lifespan of the high-pressure pump 3.

Figure 5:
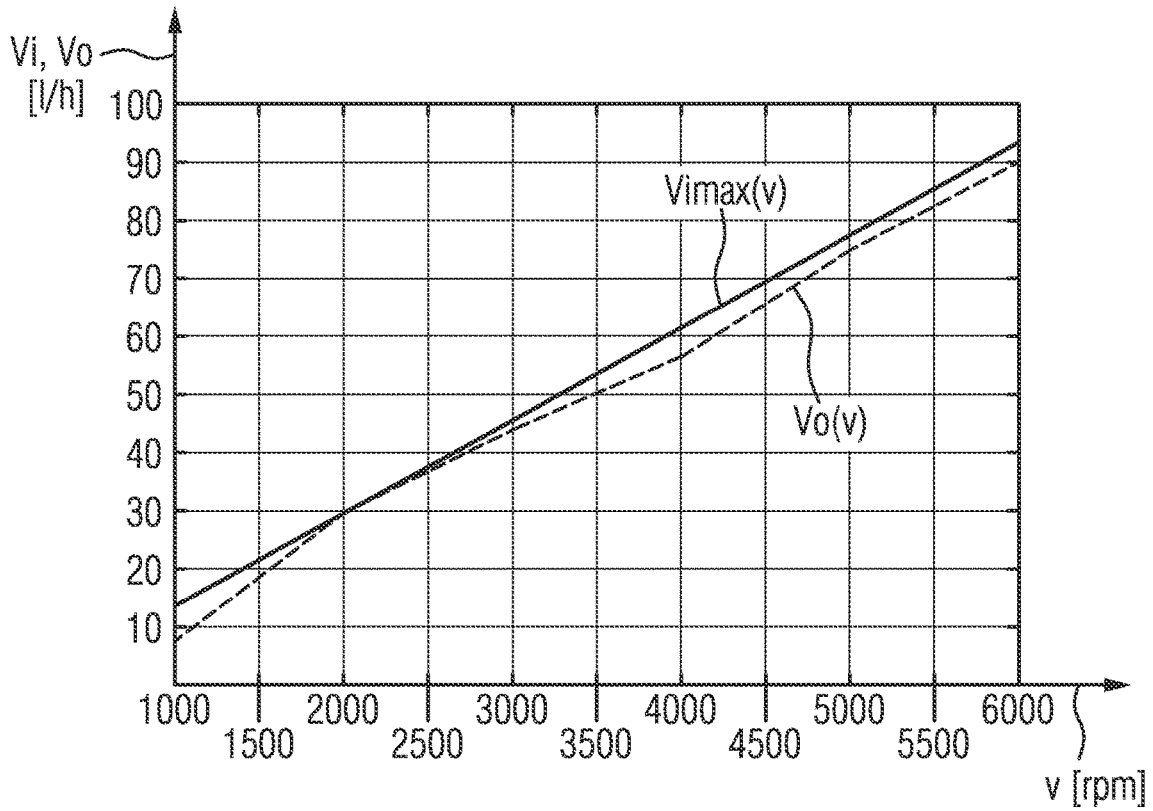
FIG. 5 shows a flow current of the high-pressure pump of a fuel-supply system according to FIG. 1 and FIG. 2 as well as an injection quantity of injection valves of the fuel-supply system and FIG. 6 shows a course of a pressure of a fuel-supply system according to FIG. 1 and FIG. 2.

FIG. 5 shows the maximum flow rate Vimax of the high-pressure pump 3 dependent on the pump speed v as well as the total injection quantity Vo. The respective injection quantity to be metered is thereby limited in such a way that the total injection quantity Vo does not exceed the maximum flow rate Vimax.

FIG. 6 shows several exemplary pressure characteristics K_P1, K_P2, K_P3 which are each representative of the course of the pressure P, in each case dependent on the temperature T1, T2, T3 over a time t with a predetermined first efficiency of the high-pressure pump 3. The pressure characteristics K_P1, K_P2, K_P3 are stored for example in the data and program memory of the control device 25 in which additionally, for example, further pressure characteristics with a predetermined further efficiency are stored. The efficiency characteristic can for example be determined by means of interpolation.

The invention claimed is:

1. A device for operating a fuel-supply system for an internal combustion engine, the fuel-supply system having a high-pressure pump, a high-pressure fluid accumulator with at least one injection valve and a high-pressure sensor, a measurement signal of the high-pressure sensor being representative of a pressure within the high-pressure fluid accumulator, wherein on an outlet side the high-pressure pump being fluidically connected to the high-pressure fluid accumulator, the device comprising:

a controller programmed to:

determine a respective maximum injection quantity of the at least one injection valve based on the measurement signal of the high-pressure sensor;

determine an efficiency characteristic which is representative of an efficiency of the high-pressure pump based on the measurement signal of the high-pressure sensor and based on a speed of the high-pressure pump;

determine the respective maximum injection quantity in dependence on the efficiency characteristic; and in response to determining that a maximum flow rate of the high-pressure pump is less than a total injection quantity, control the at least one injection valve dependent on the efficiency characteristic such that a respective injection quantity to be metered of the at least one injection valve is limited to the respective maximum injection quantity.

2. The device according to claim 1, wherein the controller is programmed to determine the efficiency characteristic based on a transmission ratio of the speed of the high-pressure pump to a speed of the internal combustion engine.

3. The device according to claim 1, wherein the controller is programmed to determine the efficiency characteristic only at a time of an initial startup of the fuel-supply system.

4. The device according to claim 1, wherein the controller is programmed to determine a temperature characteristic based on a measurement signal of a temperature sensor of the fuel-supply system, and determine the respective maximum injection quantity based on the temperature characteristic.

5. The device according to claim 1, wherein the controller is programmed to prevent a fall in pressure in the high-pressure fluid accumulator by determining the efficiency characteristic, determining the respective maximum injection quantity in dependence on the efficiency characteristic, and limiting the respective injection quantity to be metered to the respective maximum injection quantity.

6. The device according to claim 1, wherein the controller avoids an increase in an emission of harmful substances by preventing the fall in pressure in the high-pressure fuel accumulator.

7. A method of operating the fuel-supply system according to claim 1, which comprises the steps of:

providing the fuel supply system according to claim 1:

determining a respective maximum injection quantity of the at least one injection valve in dependence on the measurement signal of the high-pressure sensor;

determining an efficiency characteristic which is representative of an efficiency of the high-pressure pump in dependence on the measurement signal of the high-pressure sensor:

determining the respective maximum injection quantity in dependence on the efficiency characteristic; and in response to determining that a maximum flow rate of the high-pressure pump is less than a total injection quantity, controlling the at least one injection valve dependent on the efficiency characteristic such that a respective injection quantity to be metered of the at least one injection valve is limited to the respective maximum injection quantity.

8. The method according to claim 7, which further comprises:

determining a flow rate characteristic which is representative of a flow rate of the high-pressure pump based on the measurement signal of the high-pressure sensor: and determining the respective maximum injection quantity based on the flow rate characteristic.

9. The method according to claim 7, which further comprises:

providing at least one fuel characteristic which is in each case representative of an elasticity modulus of a respective fuel type; and determining the respective maximum injection quantity based on the at least one fuel characteristic.

10. The method according to claim 9, which further comprises determining the respective fuel type of a fuel present in the fuel-supply system based on a measurement signal of a fuel sensor of the fuel-supply system.

11. The method according to claim 7, which further comprises:

providing at least one pressure characteristic being representative of a time course of the pressure within the high-pressure fluid accumulator, and determining the respective maximum injection quantity based on the at least one pressure characteristic.

12. The method according to claim 7, which further comprises:

providing a temperature characteristic being representative of a temperature within the high-pressure fluid accumulator, and determining the respective maximum injection quantity based on the temperature characteristic.

13. The method according to claim 12, which further comprises determining the temperature characteristic based on a measurement signal of a temperature sensor of the fuel-supply system.

14. The method according to claim 7, which further comprises determining the respective maximum injection quantity based on a build-up of the pressure within the high-pressure fluid accumulator in a predetermined time interval after switching the internal combustion engine to a switched-on operating mode.

* * * * *